US009567179B2

(12) United States Patent
Prinsen et al.

(10) Patent No.: US 9,567,179 B2
(45) Date of Patent: Feb. 14, 2017

(54) PRINT MEDIA DISCHARGE UNIT

(71) Applicant: Océ-Technologies B.V., Venlo (NL)

(72) Inventors: Kevin H. J. R. Prinsen, Venlo (NL); Aart Nijkamp, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/804,039

(22) Filed: Jul. 20, 2015

(65) Prior Publication Data

US 2016/0185554 A1 Jun. 30, 2016

(30) Foreign Application Priority Data

Jul. 28, 2014 (EP) ..... 14178784

(51) Int. Cl.
*B65H 29/52* (2006.01)
*G03G 15/00* (2006.01)

(52) U.S. Cl.
CPC ..... *B65H 29/52* (2013.01); *G03G 15/6573* (2013.01); *B65H 2301/5133* (2013.01); *B65H 2401/212* (2013.01); *B65H 2404/513* (2013.01); *B65H 2404/533* (2013.01); *B65H 2404/561* (2013.01); *B65H 2404/611* (2013.01); *B65H 2801/27* (2013.01); *G03G 15/6538* (2013.01); *G03G 2215/00683* (2013.01)

(58) Field of Classification Search
CPC ..... B65H 29/52; B65H 2401/21; B65H 2401/211; B65H 2404/533; B65H 2404/5331; B65H 2404/561; B65H 2404/611;B65H 2801/27; B65H 2401/212; B65H 2301/5133; B65H 2404/513; G03G 15/6573; G03G 2215/00658
USPC ..... 271/264, 208
See application file for complete search history.

(56) References Cited

U.S. PATENT DOCUMENTS 4,494,166 A * 1/1985 Billings ..... B41J 29/00 361/214
4,523,754 A * 6/1985 Hisajima ..... B65H 3/44 165/47
4,771,360 A * 9/1988 Ayash ..... H05F 3/02 361/221
4,994,861 A * 2/1991 Brandon ..... G03G 15/6552 271/208

(Continued)

FOREIGN PATENT DOCUMENTS

JP 60-105160 U 7/1985

*Primary Examiner* — David H Bollinger
(74) *Attorney, Agent, or Firm* — Birch, Stewart, Kolasch & Birch, LLP

(57) ABSTRACT

A print media discharge unit includes a print media transport path along which in operation a sheet of print media is transported in a transport direction. The print media transport path is defined by a first electrically isolating print media guide and a second electrically isolating print media guide. The print media discharge unit further includes an electrically grounded electrically conductive discharge element extending through an opening in at least one of the first and second electrically isolating print media guides into the print media transport path. At least one of the first and second electrically isolating print media guide includes a plurality of guidance ribs aligned substantially in the transport direction at an angle with respect to the transport direction.

8 Claims, 5 Drawing Sheets

(56) References Cited

U.S. PATENT DOCUMENTS

| | | | | |
|---|---|---|---|---|
| 2005/0087923 | A1* | 4/2005 | Inoue | B65H 29/52 271/264 |
| 2006/0083569 | A1 | 4/2006 | Chang | |
| 2009/0324311 | A1* | 12/2009 | Matsumoto | B65H 5/36 399/400 |
| 2014/0232789 | A1* | 8/2014 | Mimoto | B41J 2/1433 347/47 |

* cited by examiner

PRINT MEDIA DISCHARGE UNIT

FIELD OF THE INVENTION

The invention pertains to a print media discharge unit, comprising a print media transport path along which in operation a sheet of print media is transported in a transport direction, the print media transport path is defined by a first electrically isolating print media guide and a second electrically isolating print media guide.

The invention also relates to a print media guidance assembly, a sheet stacking device and an image reproduction apparatus comprising such a print media discharge unit.

BACKGROUND ART

A device of this kind is described in U.S. Pat. No. 4,494,166. The device includes at least two grounded carbon fiber brush static eliminators mounted in a plastic baffle assembly wherein one of the fiber brushes is in a contact position and the other fiber brush is in a non-contacting position with respect to the paper path.

SUMMARY OF THE INVENTION

In a first aspect of the present invention, a print media discharge unit is provided further comprising an electrically grounded electrically conductive discharge element extending through an opening in at least one of said first and second electrically isolating print media guides into the print media transport path, wherein at least one of said first and second electrically isolating print media guide comprise a plurality of guidance ribs aligned substantially in the transport direction at an angle with respect to the transport direction.

By feeding a print media through an electrically isolated portion of media transport path the electric capacity decreases, thus increasing the voltage which makes it easier to discharge the sheet by means of the electrically grounded electrically conductive discharge element, such as a fiber brush. However, such an electrically grounded electrically conductive discharge element can influence print media transport during it's contacting engagement with the print media. The configuration of the first and second electrically isolating print media guide comprise a plurality of guidance ribs aligned substantially in the transport direction at an angle with respect to the transport direction. By mounting the guidance ribs at an angle the reliability of the print media transport increases significantly. In particular in case print media arrives in imperfect state to the print media discharge unit, e.g. due to dog ears, small tears or other defects in combination with the contacting discharge element.

The first and second electrically isolating print media guides may e.g. be implemented as a single moulded work piece, or alternatively e.g. as two moulded pieces in a bracket.

In an embodiment, the guidance ribs are aligned at an angle with respect to the transport direction between −45 and +45 degrees. Slanted mounting of the ribs with respect to the transport direction provide for a more robust media transport in particular for print media defects. The guidance ribs may vary the angles of every individual rib or may be e.g. in two symmetric groups around the center line of media transport. In a preferred embodiment the guidance ribs are mounted in three groups. A first center group with guidance ribs at substantially 0 degree angle, i.e. parallel to the direction of transport. The two remaining groups of guidance ribs are symmetrically mounted around the first group at an angle of approximately 45 degrees, i.e. 45 degrees for the second group and −45 degrees for the third group.

In an embodiment, the electrically grounded electrically conductive discharge element is mounted slanted at a non-perpendicular angle with respect to the transport direction. By slanting the discharge elements at an angle the disturbances during transport through the print media discharge unit, in particular the inhomogeneous disturbances over the width are reduced and the wear of the discharge elements due to contacting engagement with the print media are reduced.

In an embodiment, the outer surface of the guidance ribs consist of plastic. To reduce the electric capacity of the structure comprising the print media, an electrically isolated environment is preferred.

In another aspect of the present invention, a print media guidance assembly is provided, comprising a print media transport path along which in operation the print media is transported in the transport direction, the print media transport path is defined by a first substantially electrically conductive print media guide and a second substantially electrically conductive print media guide, the print media guidance assembly further comprises drive means for transporting a print media along the print media transport path of the print media guidance assembly and a print media discharge unit in accordance with the first aspect of the present invention.

By isolating a portion of the print media transport path at the discharge station, the electric capacity is reduced locally at the discharge station, where substantially the rest of the transport path is electrically conducting thereby reducing the build up of static electricity on the print media.

In another aspect of the present invention, a sheet stacking device is provided, comprising means for receiving and aligning subsequent incoming sheets of print media, a support member for supporting a stack of print media and a print media discharge unit according to the first aspect of the present invention.

In sheet stacking devices, the quality is highly depending on the straightness of the stack. Straightness of the stack can be significantly deteriorate by static electricity on print media. By feeding print media through a print media discharge unit the quality of the stacking device is improved significantly.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
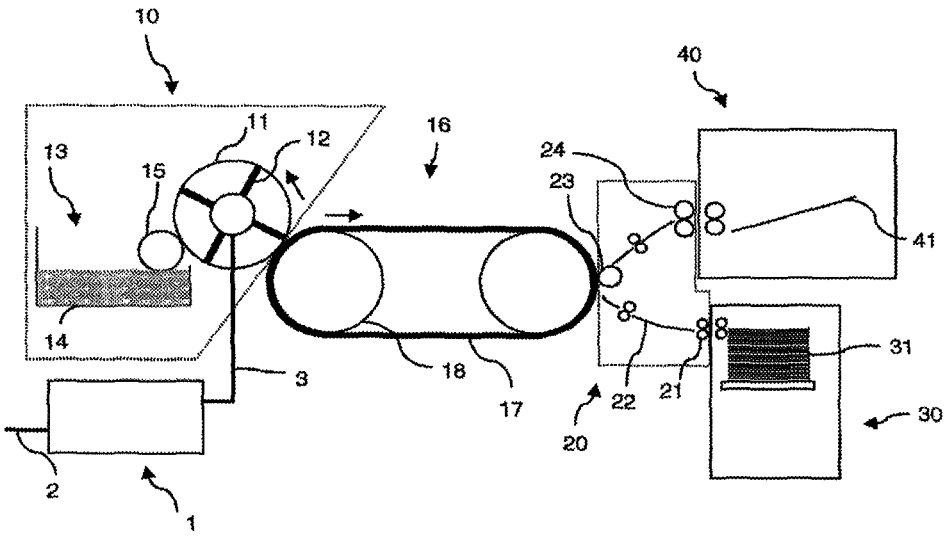
FIG. 1 shows a schematic view of a print engine in which the device according to the present invention may be used.

The present invention will now be described with reference to the accompanying drawings, wherein the same reference numerals have been used to identify the same or similar elements throughout the several views.

FIG. 1 shows a print engine for printing images. The print engine comprises a converter 1 to convert image data into a print signal, an image forming module 10 to apply marking material corresponding to the print signal, the marking material being brought in contact with the image forming element 11 by a developing unit 13, an intermediate member 16 for transferring the marking material to the image fixing module 20, an image receiving member input station 30 for bringing in an image receiving member, usually sheets media, and a delivery station 40 for receiving the finished output product. In this embodiment the marking material is conventionally toner, which comprises a resin that is softened by heat.

The image data are supplied to the print engine through a data connection 2. This may be any suitable data connection, depending among other things on the required bandwidth. The converter 1 comprises electronic circuits including programmable logic to convert an image line into a print signal that is suitable to be applied to the image forming module 10 through a data connection 3. In FIG. 1 the image forming module 10 comprises a rotatable, substantially cylindrically shaped image forming element 11 having an electronic device 12 in the inside to apply a voltage on conductive tracks under a dielectric layer on an outer surface of the image forming element. This voltage induces a local electric field outside the image forming element that attracts toner particles from developing roller 15 that receives the toner particles from a toner supply unit 14. In this way an image of toner particles is formed on the surface of the image forming element 11.

Alternatively the image forming element 11 may comprise a roller with a photoconductive layer on the outside surface of the roller. In such embodiment the surface of the photoconductive layer is charged by e.g. a corona and the print signals are applied to an imaging unit outside the roller. The imaging unit may comprise a LED-bar, or a laser scan module, that locally illuminates the layer conform the image to be printed. The photoconductivity of the layer results in a locally discharged surface. The parts of the photoconductive layer that remain charged may be used to attract toner from a toner roller like developing roller 15 by creating an electric field between these charged parts and the toner roller. In an embodiment an electric field between the charged parts and the toner roller may be provided by connecting the toner roller to a ground voltage. The toner may comprise electrically conductive particles having a specified colour or a mixture of isolating coloured particles and carrier particles that charge the isolating particles, making them sensitive to an electric field between the developing roller and the image forming element. Instead of carrier particles the developing roller may also be supplemented by a contact roller that charges the toner particles. Therefore there are various ways to obtain an image of toner particles on the surface of the image forming element. In the process of forming the image the element rotates in the direction indicated by the arrow in FIG. 1. It is further noted that in another embodiment, an imaging forming element is formed by arranging a belt with a photoconductive layer on several rollers.

The intermediate member 16 comprises a belt 17 and two guiding rollers 18, but more rollers are also possible. The belt 17 rotates in congruence with the image forming element 11 and receives the toner image in a nip where the image forming element 11 and the belt 17 are in contact. The transfer of toner may take place by the influence of mechanical forces that are induced when the top layer of the belt comprises an elastic, adhesive material, such as rubber, or by the influence of electric forces that originate from a voltage difference between the image forming element and the belt. The intermediate member 16 may further comprise a heating unit, which is not shown in FIG. 1, to control the temperature of the belt. Although only one image forming element is shown in FIG. 1, the intermediate member may be configured to have several image forming elements around it, each for a different process colour of toner particles that are collected on the belt. In this way a full colour image may be formed, e.g. by the process colours cyan, magenta, yellow and black. The intermediate member may also be configured as a drum with an outer layer that is suitable to collect the various colour particles.

The image fixing module 20 is able to transport an image receiving member, such as a sheet of paper, by transport rollers 21 and guiding means 22 to a pressure roller 23 that brings the image receiving member into contact with the belt 17 of the intermediate member 16. The image receiving member is supplied by an image receiving member input station 30 comprising a pile of sheets 31. By applying heat and pressure the toner is brought onto the image receiving member, which is transported further towards the output station 40. The image fixing module may comprise a path for turning the image receiving member to be able to print another side. The fusing rollers 24 raise the temperature of the image receiving member to further fix the printed image on the image receiving member and to enhance the printed image quality. When the temperature of the pressure roller 23 is sufficiently high, no fusing rollers are necessary. In this embodiment the print media discharge unit (not shown) is mounted along guiding means 22.

The finished output product module 40 is shown as a tray 41, on which different sheets may be stacked, but may also comprise a stapler, a hole pucher etc. for performing a post processing step. The various modules are controlled by a control unit to have their actions coordinated.

Figure 2:
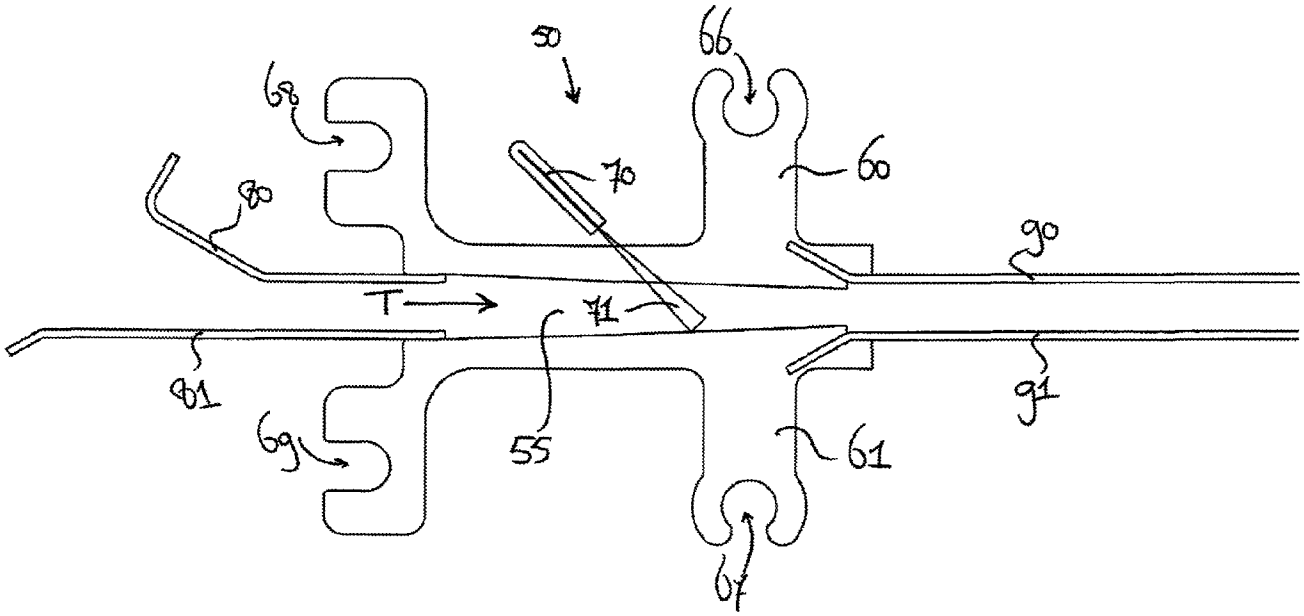
FIG. 2 shows a schematic cross-sectional view of the discharge unit according to the present invention.

FIG. 2 shows a schematic cross-sectional view of the discharge unit 50 according to the present invention.

Print media discharge unit 50 comprises a first electrically isolating print media guide 60 mounted over a second electrically isolating print media guide 61. The second isolating print media guide forms the bottom media guide and due to a spacing between the first guide 60 and the second guide 61 a print media transport path 55 is defined in between the first and second isolating media guides 60, 61 to facilitate a print media transport through this print media transport path 55 in a transport direction T. Sheets of print media are fed through this paper path by means of an upstream portion of the metal print media guides 80 and 81 from the print engine and fixation station. The sheets of print media are fed through the discharge unit 50 via metal print media guides 90 and 91 towards a downstream processing unit, such as in casu a high capacity stacker to form a stack of sheets from the incoming subsequently fed sheets of print media. The isolating elements defining the media transport path 55 through the discharge unit 50 comprise apertures through which an electrically grounded brush 70 with conducting brush fibres is mounted such that the fibres contact a print media during its transport through the discharge unit. The isolating print media guides 60, 61 comprise mounting sections to enable easy replacement of the discharge unit into the printing system by means of a click on/off system facilitated by grippers 66, 67, 68, 69.

Figure 3:
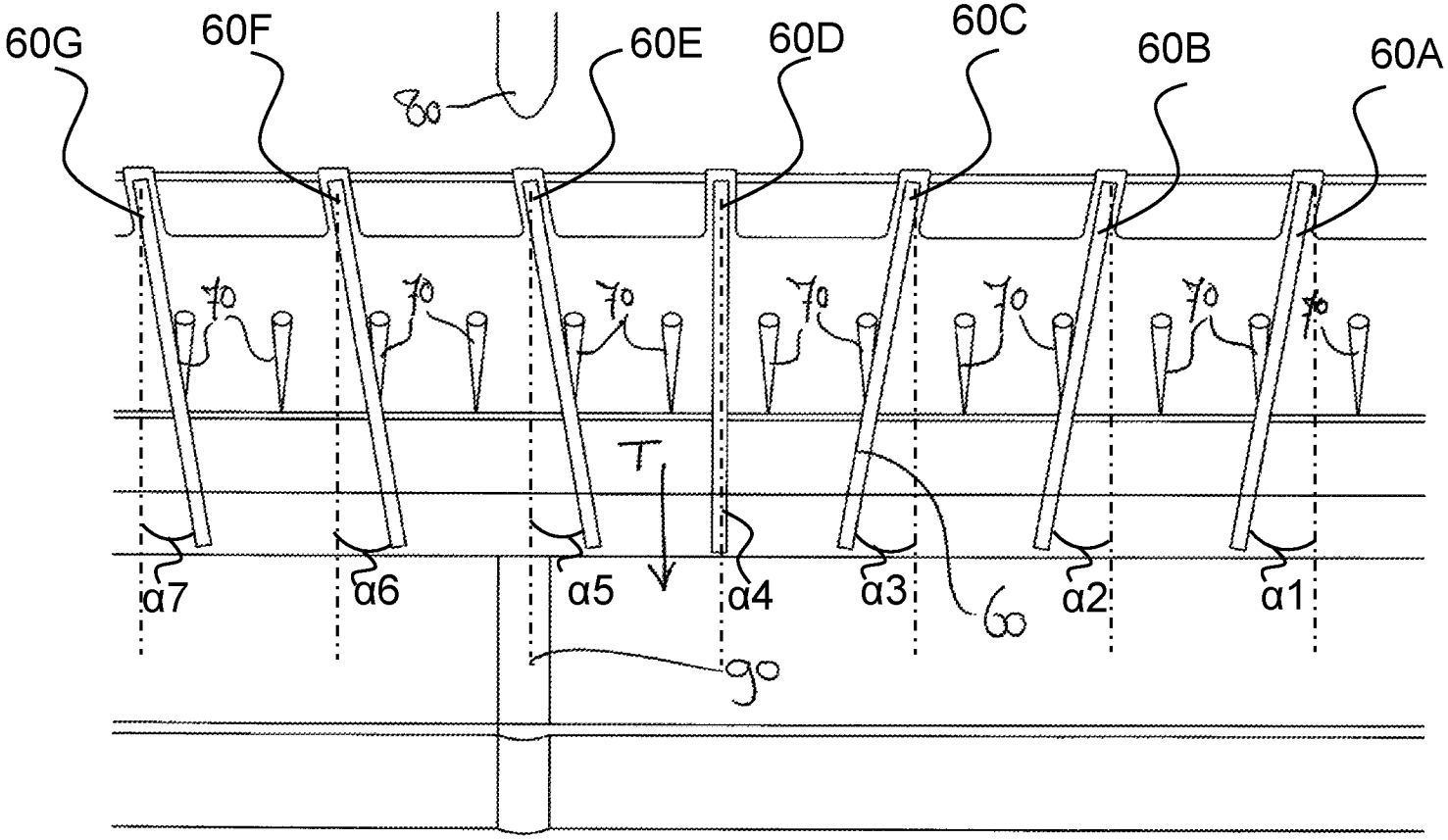
FIG. 3 shows a schematic top view of a detail of the discharge unit according to the present invention.

FIG. 3 shows a schematic top view of a detail of the discharge unit according to the present invention. The brush 70 can be an integral unit or distributed into a plurality of smaller brushes. The isolating top portion of the media guide 60 comprises slanted ribs 60A-60G at an angle $\alpha$1-$\alpha$9 with respect to the direction of transport T. This increases the robustness for defects in print media such as dog ears or tears. In particular locally at the brush 70 where the sheet of print media physically engages with the brush 70.

Figure 4:
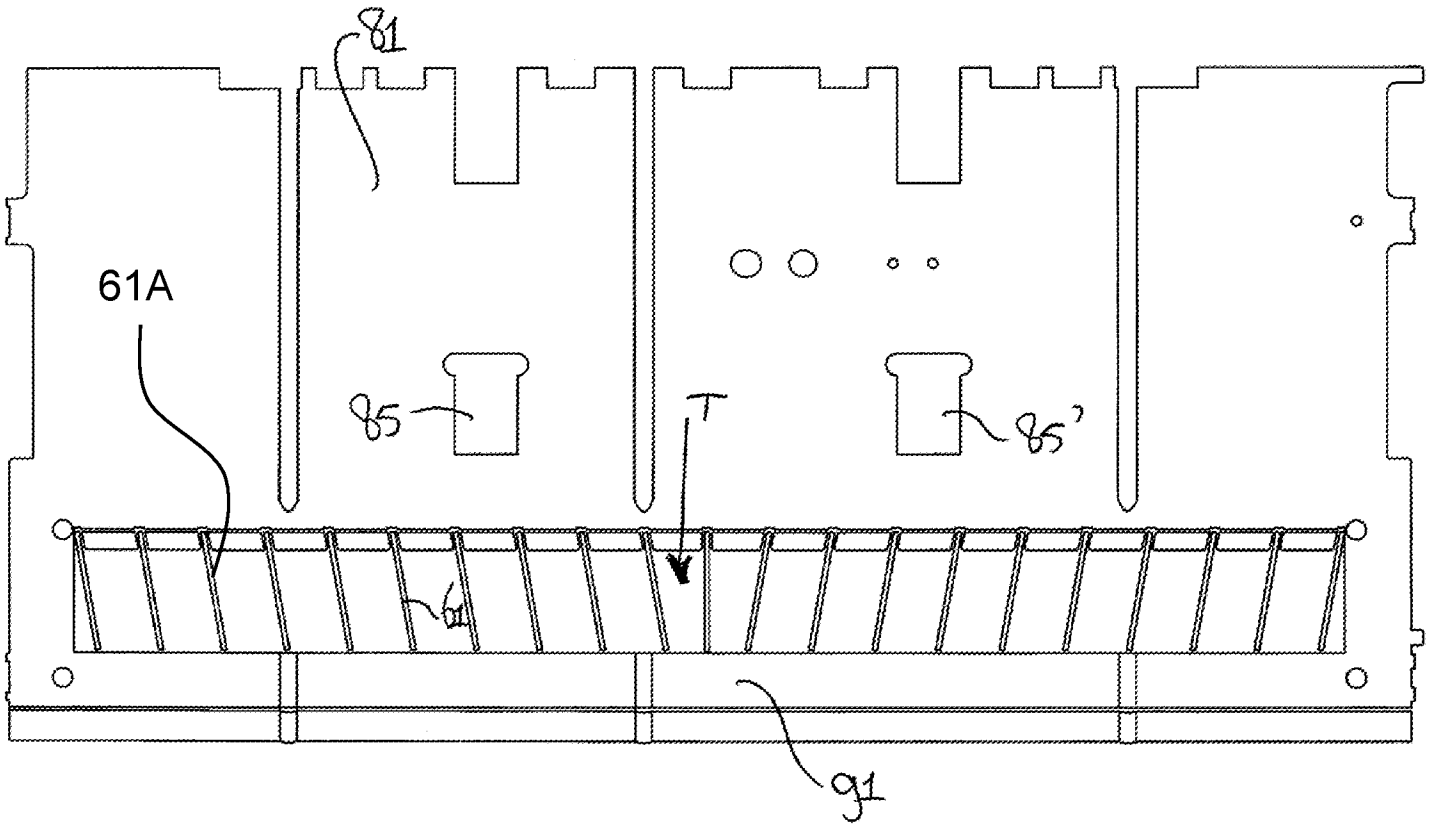
FIG. 4 shows a schematic bottom view of a portion of the discharge unit according to the present invention.

FIG. 4 shows a schematic bottom view of a portion of the discharge unit according to the present invention. As shown in this figure the bottom metal print media guides 81 and 91 are formed as an integral single piece of sheet metal with a large aperture to receive the discharge station. In an alternative embodiment the upstream and downstream media guides are formed as separate pieces mounted to a supporting frame.

The upstream sheet metal guide element 81 comprises two additional apertures 85 and 85' to accommodate drive rollers (not shown) to transport the sheet of print media. As seen in this figure the isolating portion of the bottom media guide 61 comprises guide ribs 61A and is mounted to the metal guide element by means of the click on/off mechanism.

Figure 5:
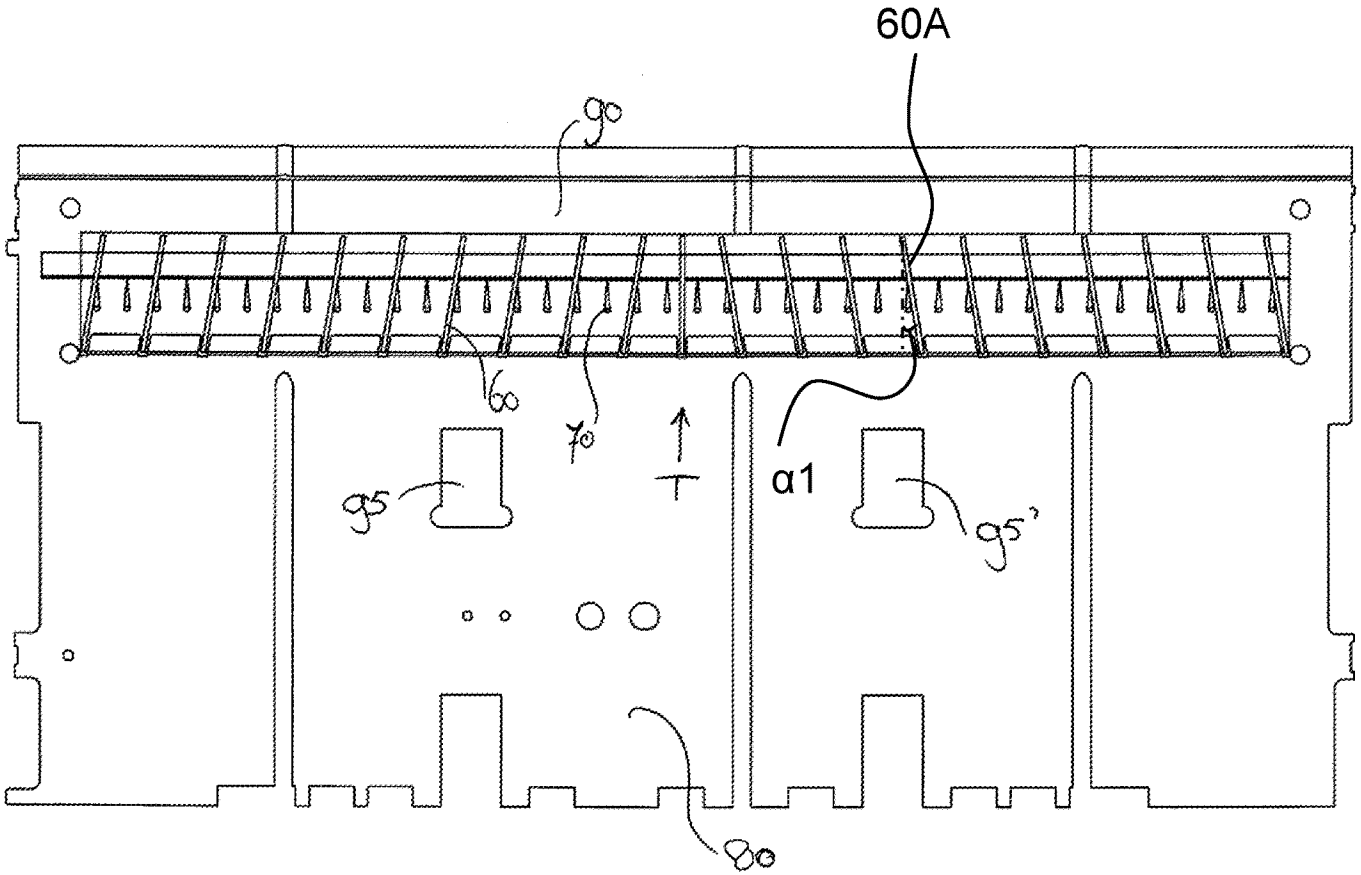
FIG. 5 shows a schematic top view of a portion of the discharge unit according to the present invention.

FIG. 5 shows a schematic top view of a portion of the discharge unit according to the present invention. As shown in this figure the top metal print media guides 80 and 90 are formed as an integral single piece of sheet metal with a large aperture to receive the discharge station. In an alternative embodiment the upstream and downstream media guides are formed as separate pieces mounted to a supporting frame.

The upstream sheet metal guide element 80 comprises two additional apertures 95 and 95' to accommodate drive rollers (not shown) to transport the sheet of print media. As seen in this figure the isolating portion of the bottom media guide 60 comprises guide ribs 60A-60G and is mounted to the metal guide element by means of the click on/off mechanism. The space between the ribs 60A-60G of guide element 60 accommodate the electrically grounded brush 70.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A print media discharge unit, comprising a print media transport path along which in operation a sheet of print media is transported in a transport direction, the print media transport path being defined by a first electrically isolating print media guide and a second electrically isolating print media guide, the print media discharge unit further comprising an electrically grounded electrically conductive discharge element extending through an opening in at least one of said first and second electrically isolating print media guides into the print media transport path, wherein at least one of said first and second electrically isolating print media guide comprise a plurality of guidance ribs, and wherein the guidance ribs are aligned substantially in the transport direction at an angle with respect to the transport direction when viewed in a direction perpendicular to the transport direction from a top of the print media transport path.

2. The print media discharge unit according to claim 1, wherein the angle is in a range from 0 to 45 degrees.

3. The print media discharge unit according to claim 1, wherein the electrically grounded electrically conductive discharge element is mounted slanted at a non-perpendicular angle with respect to the transport direction.

4. The print media discharge unit according to claim 1, wherein the outer surface of the guidance ribs consist of plastic.

5. The print media guidance assembly comprising a print media discharge unit according to claim 1, wherein the print media transport path is defined by a first substantially electrically conductive print media guide and a second substantially electrically conductive print media guide, the print media guidance assembly further comprises drive means for transporting a print media along the print media transport path of the print media guidance assembly.

6. A sheet stacking device, comprising means for receiving and aligning subsequent incoming sheets of print media, a support member for supporting a stack of print media and a print media discharge unit according to claim 1.

7. An image reproduction apparatus comprising an image marking station for applying an image of marking material onto a print media and a print media discharge unit according to claim 1.

8. A method of modifying an image reproduction apparatus comprising the subsequent steps of:

a) removing a portion of the print media guides defining the print media transport path, creating an aperture for receiving a print media discharge unit;

b) mounting a print media discharge unit according to claim 1;

c) connecting the electrical ground of the print media discharge unit to an electrically grounded portion of the image reproduction apparatus.

* * * * *